US005592986A

United States Patent [19]

Auger et al.

[11] Patent Number: 5,592,986

[45] Date of Patent: Jan. 14, 1997

[54] BULLET MOLDING APPARATUS

[76] Inventors: Armande P. Auger, 3546 Morgan Ave. South, Minneapolis, Minn. 55412; Roger L. Barnes, 1210 Alexander Rd., Colorado Springs, Colo. 80909

[21] Appl. No.: 543,899

[22] Filed: Oct. 17, 1995

[51] Int. Cl.[6] ..... B22C 9/22; B22D 25/02; B22D 31/00

[52] U.S. Cl. ..... 164/335; 164/133; 164/264; 249/108; 249/110

[58] Field of Search ..... 164/264, 262, 164/69.1, 70.1, 133, 335; 249/108, 110, 170, 171

[56] References Cited

U.S. PATENT DOCUMENTS

| | | | |
|---|---|---|---|
| 35,334 | 5/1862 | Tatham | 249/110 X |
| 1,285,958 | 11/1918 | Eckford | 249/110 |
| 3,718,310 | 2/1973 | Cerone | 164/264 X |
| 3,749,351 | 7/1973 | Lee | 249/170 |
| 4,089,501 | 5/1978 | Zahoran | 164/262 X |
| 4,624,297 | 11/1986 | Clausen | 164/335 X |

*Primary Examiner*—J. Reed Batten, Jr.
*Attorney, Agent, or Firm*—Roger W. Jensen

[57] ABSTRACT

The apparatus comprises first and second mold blocks, each having a pair of matching mold half cavities and being adapted to be held in assembled relationship with the half cavities in abutting register, to define, a pair of full cavities. The apparatus further includes a sprue cutter plate pivotally mounted on the upper surface of one of the blocks. The sprue plate also has (i) a pair of orifice holes in a lower planar surface spaced so as to be aligned with the tops of the full cavities, (ii) a pair of spaced apart countersinks recessed into an upper planar surface and in respective connecting register with the pair of orifice holes, and (iii) a trough in the upper planar surface connecting the pair of countersinks. The apparatus further includes a source of molten metal controllable to provide a preselected stream of molten metal for a preselected length of time to initially impinge the mid point of the trough and thence flow laterally to both of the countersinks and thence downwardly through the orifices into the pair of full cavities.

8 Claims, 4 Drawing Sheets

FIG. 6
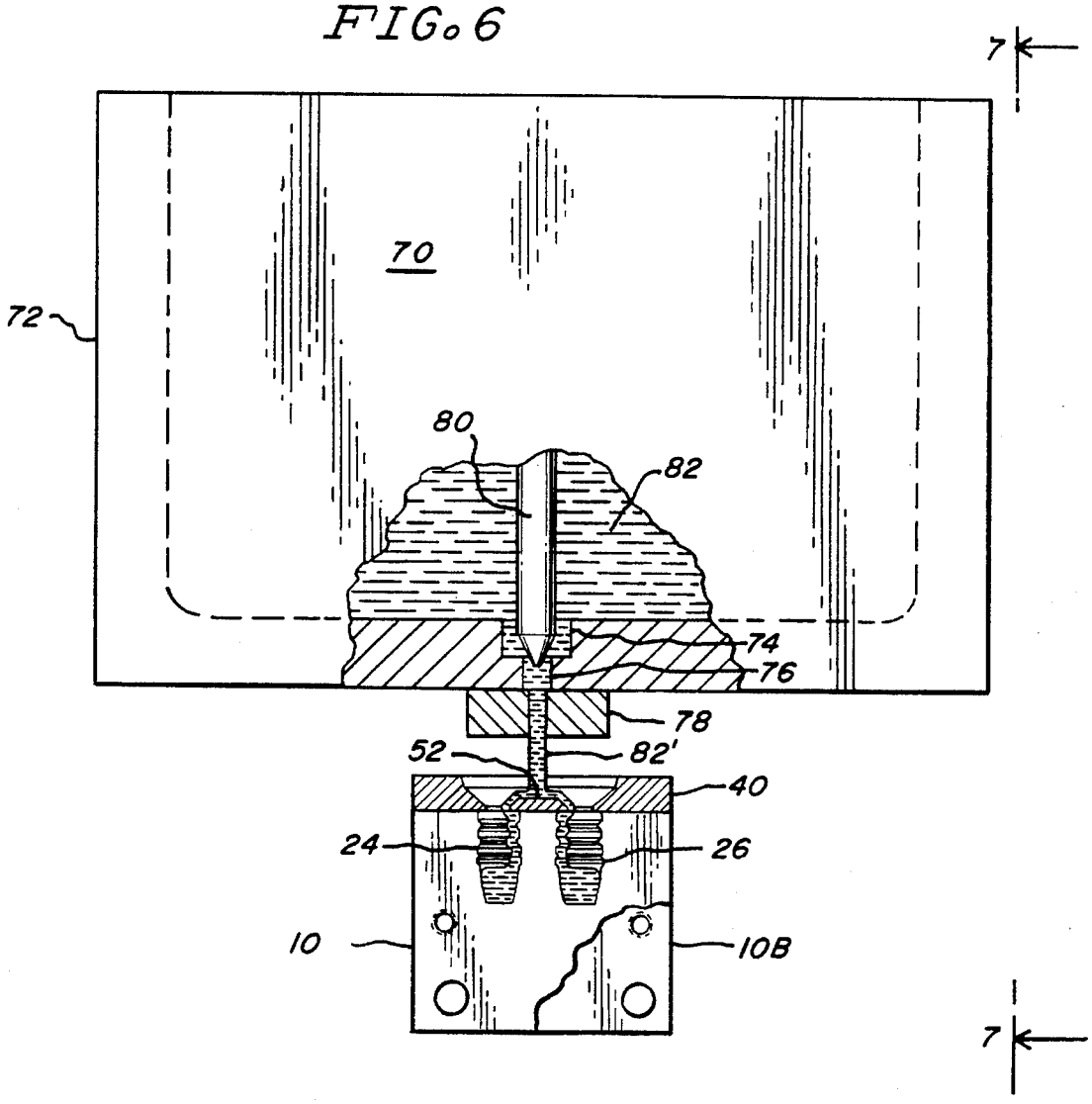
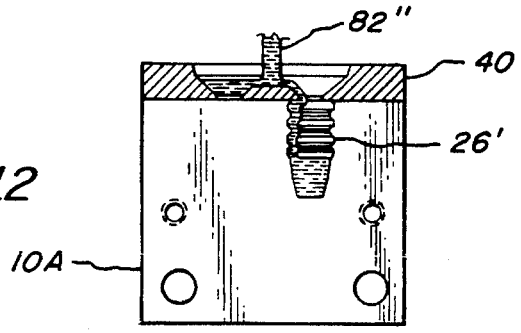
FIG. 12

BULLET MOLDING APPARATUS

BACKGROUND OF THE INVENTION

This invention relates to an apparatus and a process for molding, i.e., casting and manufacturing cast bullets for small ammunition, the metal typically being lead or lead alloy.

The making or manufacture of cast bullets using molten lead or lead alloy is an art or technology that goes back several hundred years following the invention of gun powder. In broad terms, bullets were cast, in one prior art process, by pouring molten lead or lead alloy into a mold consisting of two blocks with one half of the bullet-shape or form cut into the inner face of each mold half, the two halves, when assembled together, jointly forming a cavity. The mold halves or blocks were held together on handles and aligned by suitable means such as pins in the blocks or on carriers. Molten metal then is poured into the mold cavity with some excess metal being provided on the top to allow for shrinkage as the metal cools. Early bullet molds had a small hole through which the metal was poured forming a small stem or sprue. After the molten metal had solidified and the mold was opened, the bullet or bullets, as the case may be for multiple cavities, were allowed to drop out. The stem or sprue was cut flush with the end of the bullet using an appropriate means such as a pair of nippers. Some molds had nippers or other cutting means built into the mold handles.

The next step in the evolution of bullet casting was the development of a mold with an integral sprue cutter plate with a countersink in the top face of the sprue cutter and with a small hole or orifice at the bottom of the countersink through which the metal flowed into the mold cavity. In the case of multicavity molds there is a countersink with an orifice in the sprue cutter spaced to register with each mold cavity. An example of a prior art sprue cutter is U.S. Pat. No. 3,870,272. The sprue cutter concept had several advantages over the prior art. First it provided greater control of the pour of metal, second it allowed the riser or stem to be eliminated as the bottom face of the sprue cutter is directly adjacent to the bullet base (or nose of the bullet as is the case of nose pour bullet molds) and hence there is no riser. Thirdly, the sprue cutter cuts off the sprue before the bullets are dropped from the mold. This apparatus resulted in a significant increase in production rates and quality of the bullet. There are variations in the integral sprue cutter as above described. There are variations in the size of countersinks and orifice holes as well as the location of the sprue cutter pivot point. In addition, there are some gang mold sprue cutters having a plurality of bullet cavities and an equal number of countersinks with a narrow trough connecting the countersinks in the sprue cutter. This allows a choice of filling each cavity individually or filling one cavity and then allowing the metal to flow along the trough to the next cavity until it fills and hence from cavity to cavity until each one is filled. Prior art molds of this type with up to 10 cavities linked by a narrow trough have been supplied by (i) SAECO and (ii) Hensley and Gibbs. Problems with the above described gang mold are the high scrap rate produced by trapped air and poor bullet fillout and low shooting accuracy.

There are major disadvantages to the bullet casting apparatus and sprue cutters thus far described. When liquid metal is poured into a bullet mold directly through the orifice hole at the bottom of the countersink in a sprue cutter, it strikes the bottom of the mold cavity with enough velocity and force to cause splashing and turbulence. This effect throws metal up and around the sides of the mold cavity. The metal that is thrown up begins to solidify before the rest of the metal enters the cavity and can block the air vents before the mold cavity is filled. Also the turbulence causes internal and external air pockets or voids in the bullet and produces an imbalance condition wherein the center of gravity of the bullet is not exactly aligned with the longitudinal axis of the bullet. Depending upon the severity of the imbalance, the bullet's flight is adversely effected from a minor extent where the accuracy is adversely degraded to a major extent where the bullet will completely miss the mark or target. The air pockets above described occur randomly and unpredictably. The effect on the bullet's accuracy is directly proportional to the size and location of such voids or air pockets. Rigorous visual and weighing inspection of the bullets can assist in identifying bad bullets, but this is time consuming and expensive and further does not really address the problem of the bullet's center of gravity being out of alignment with the bullet's longitudinal axis. At this point of time commercial bullet casters visually inspect one-hundred percent of the product at least twice before packaging and shipping. One-hundred percent weight inspection is impractical due to the very high cost of high speed weighing equipment. It should be understood that tolerances of four-tenths of a grain to two grains, depending upon bullet weight, is the criteria for rejecting or accepting a bullet. The cost of high speed weighing equipment having this sensitivity is prohibitive. Furthermore, this still leaves the commercial caster and the consumer with the problem of hidden internal voids with the resultant effects on the bullet's performance and accuracy as aforesaid.

SUMMARY OF THE INVENTION

The present invention provides a relatively simple apparatus that improves upon the prior art and provides bullets with minimal air pockets and thus avoids the significant disadvantages of the prior art processes.

The present invention provides a unique improvement over the prior bullet casting apparatus in that it, in the preferred embodiment, provides a sprue plate with at least one pair (or multiples of a pair) of countersinks with associated orifice and with a relief or trough formed between and connecting each pair of countersinks. In the preferred embodiment the relief or trough is formed to the same width as the diameter of the countersinks and the relief has radiused sides, a flat at the bottom of the relief and the relief is blended or tapered with respect to the countersinks at each end of the relief. Importantly, when filling the mold cavities, a single stream of molten lead or lead alloy is directed from above the mold perpendicular to the sprue cutter mold assembly into the center of the trough of the sprue cutter. The metal then flows along the trough in both directions down through the countersinks through the orifice holes, at the bottom the countersinks, and into the mold cavities filling them simultaneously. For gang molds the process is repeated at each pair of cavities. For a gang mold, the sprue cutter must have the above described configuration at each pair of cavities.

The unique apparatus of this invention has one very important advantage over the prior art arrangement, i.e., the above described air bubble problem is essentially eliminated. Thus high quality bullets can be manufactured at relatively low unit cost, these bullets are characterized by having the center of gravity aligned with the bullet longitudinal axis to facilitate high shooting accuracy.

DESCRIPTION OF DRAWINGS

FIG. 6 shows a complete bullet molding apparatus;

FIG. 12 is a side view, in section, of a molding block and sprue cutter utilizing the invention but casting only a single bullet.

DETAILED DESCRIPTION OF THE INVENTION

Figure 4:
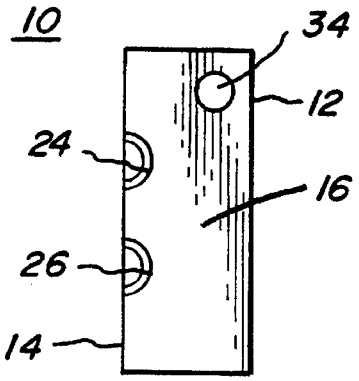
FIGS. 4 and 5 show respectively the top and bottom views of the mold block shown in FIG. 1.
Figure 5:
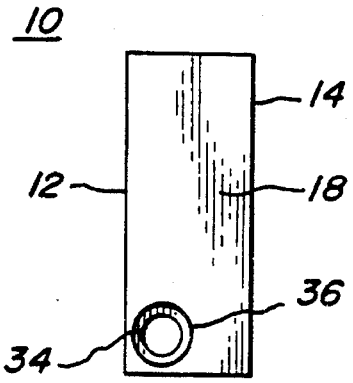
Figure 3:
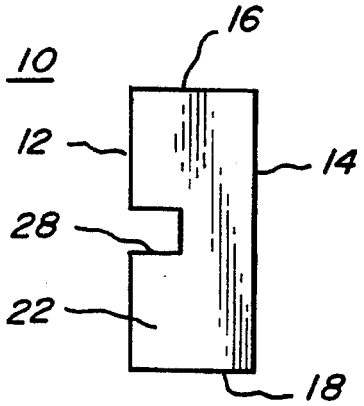
FIG. 3 shows a right side view of the mold block of FIG. 1.

FIGS. 1–5 show views of a mold block which may be used with the invention, however, it should be understood that various mold block configurations may be used with the invention.

Referring to FIGS. 1–5, reference numeral 10 generally depicts a mold block having an outer face 12, an inner face 14 upper and lower planar surfaces 16 and 18, and opposing end surfaces 20 and 22.

Figure 2:
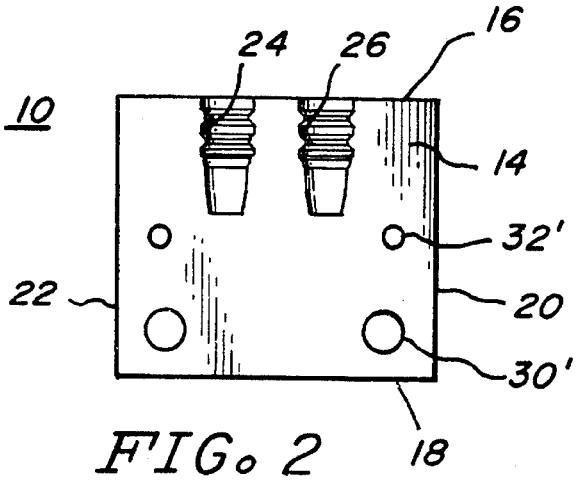
FIG. 2 shows the inner face of the mold block of FIG. 1.
Figure 1:
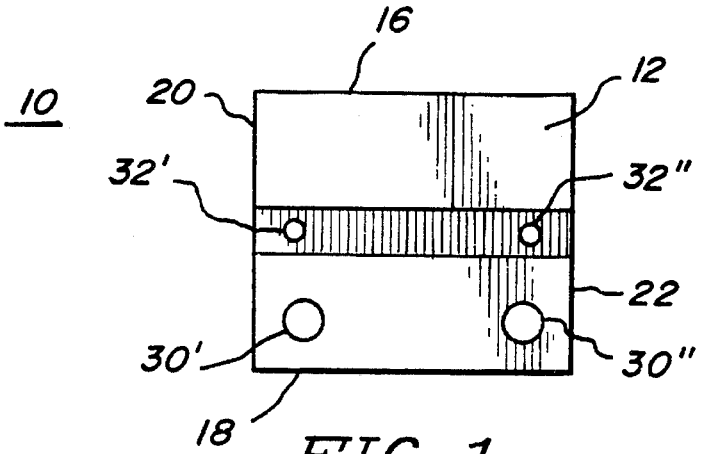
FIG. 1 shows the outer face of a mold block which may be used with our invention.

The mold 10 has recessed into its inner face 14 a pair of mold half cavities 24 and 26 configured to be in the shape of the desired bullets (more accurately half of the desired bullet), see FIGS. 2 and 4.

A notch or slot 28 extends along the outer face 12 between the two opposite ends 20 and 22 and a pair of bores or holes 30' and 30" extend through the mold 10 from the outer face 12 to the inner face 14. A pair of threaded bores or holes 32' and 32" are provided in the block and are positioned at the bottom of notch 28 as is clearly shown in FIG. 1.

Referring to FIGS. 8–11, a sprue cutter is generally designated by reference numeral 40 and comprises a plate having upper and lower planar surfaces 42 and 44, and a pair of countersinks 46 and 48 in the upper planar surface 42. The countersinks are spaced apart a preselected distance corresponding to the spacing apart of the half cavities 24 and 26 in the molding block. The counter sinks 46 and 48 each have respectively an outlet orifice 46' and 48' extending to the lower planar surface 44 as is clearly shown in FIG. 11.

Figure 8:
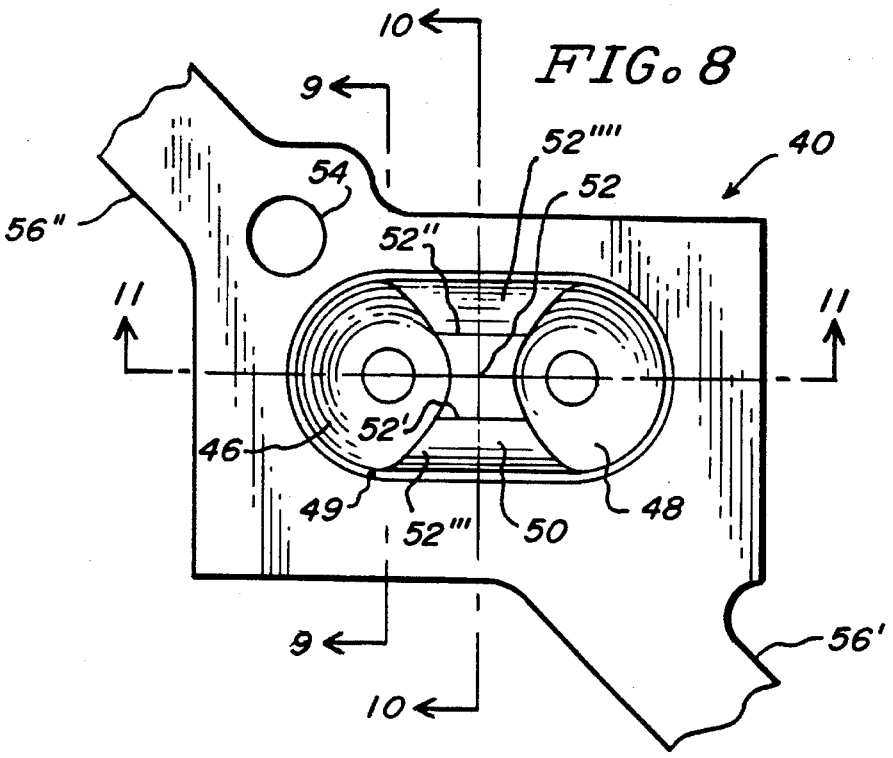
FIG. 8 is a top enlarged view of a sprue cutter which embodies the invention.
Figure 10:
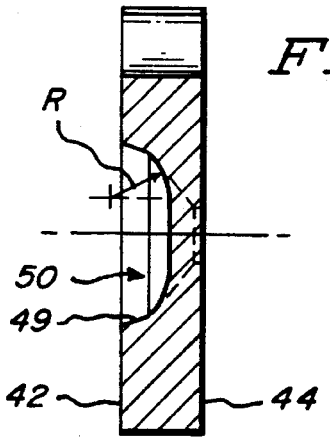
Figure 11:
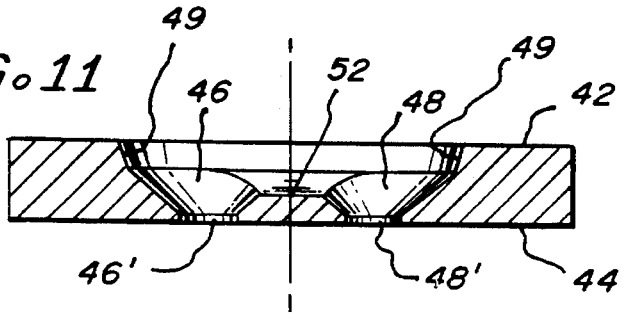

A trough or recess 50 in the upper planar surface 42 connects countersinks 46 and 48, the bottom of the trough being identified by reference numeral 52 as shown in FIG. 11. The bottom 52 of the trough is flat in both directions, i.e., from 52' to 52" as shown in FIG. 8 and from countersinks 46 to 48 as shown in FIG. 11. Beginning at 52' and 52" the trough has curved side surfaces 52''' and 52'''' (see FIG. 8) respectively which curve up to the surface 42, preferably at a single radius R shown in FIG. 10. Thus lines 52' and 52" are tangency lines between the flat bottom 52 and the curved side surfaces 52''' and 52''''.

It is important that surface 52 be flat in order to obtain the same lateral flow rates to each of the countersinks 46 and 48, as will be described below.

The sprue cutter plate shown has optional extra thickness to permit adding an optional draft 49 or additional liquid resevoir to increase hydraulic pressure on the molten metal flowing into the molds.

The sprue cutter plate further includes a bore or hole 54 in one corner thereof extending therethrough as is shown in FIG. 8. The sprue cutter also includes a pair of arms 56' and 56" extending radially away from the hole 54, the arms 56' and 56" are only partially shown in FIG. 8.

Figure 7:
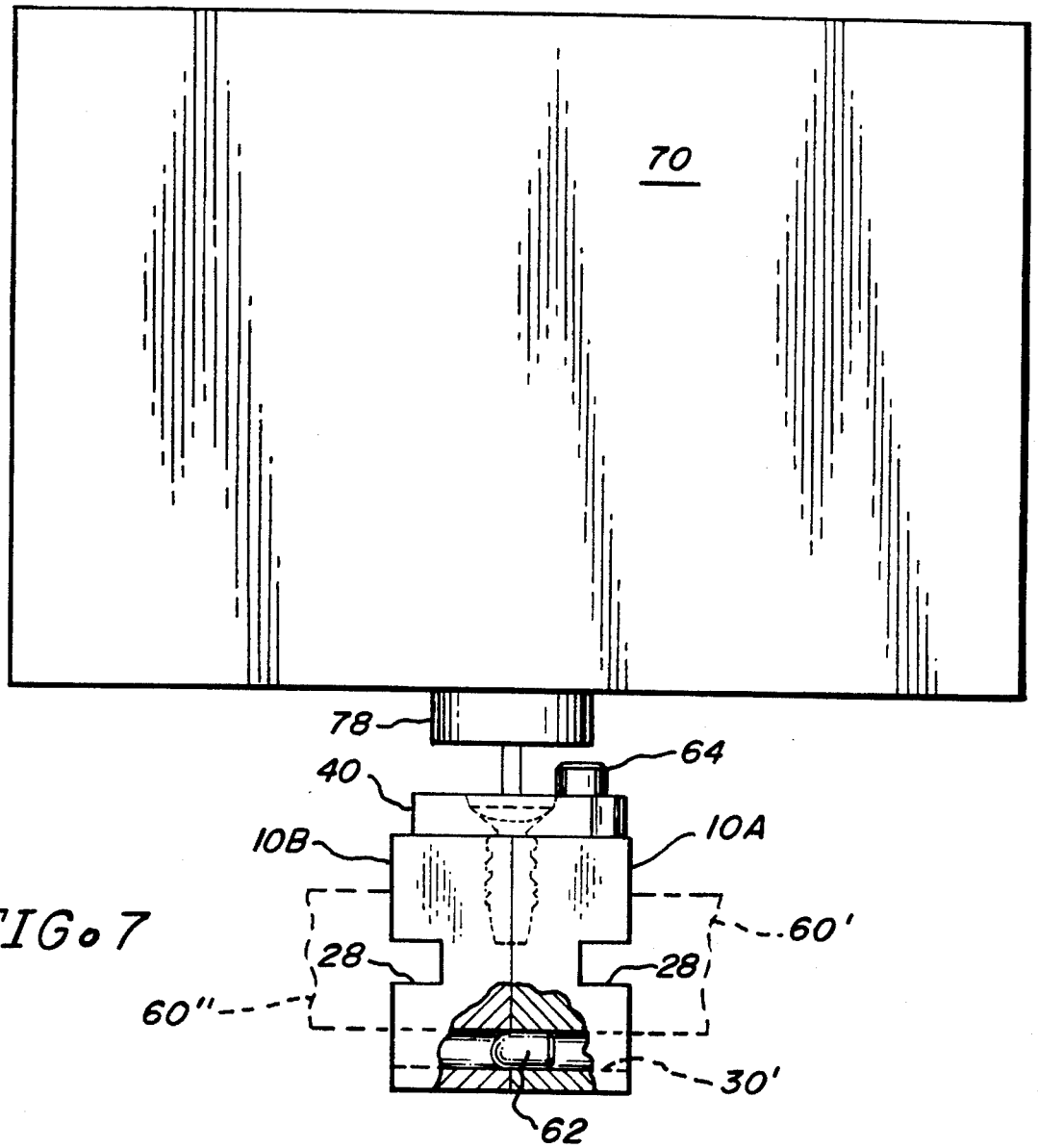
FIG. 7 is a view of the apparatus depicted in FIG. 6 as viewed along section line 7—7.

FIGS. 6 and 7 show the assembled apparatus. A pair of mold blocks 10A and 10B, each having inner faces with a pair of matching mold half cavities, are held in assembled relationship with the half cavities in abutting register. Suitable fixture means 60' and 60" coact with notches 28 to hold the blocks 10A and 10B using screw means (not shown) threaded into threaded bores 32' and 32". Further, the molding blocks 10A and 10B are held in exact register by a pin or dowel means 62 positioned in hole 30'.

The sprue cutter plate 40 is pivotally mounted on the upper surface of block 10A. A machine screw 64 passes through bore 54 in the cutter 40 and through bore 34 in block 10A and is threaded into a suitable nut held in recess 36 at the bottom of the block. Thus plate 40 is held snugly against the top surfaces 16 of blocks 10A and 10B but may be rotated about the longitudinal axis of screw 64.

A source of molten metal 70 is shown somewhat schematically in FIGS. 6 and 7 and comprises a container 72 having a stepped opening 74 and 76 in the bottom thereof and a spout means or orifice plate 78 in register therewith. Molten metal 82 in container 72 is maintained in a liquid state by heating means, not shown. A control rod 80 within the container has a pointed end coacting with the step defined between 74 and 76 and being vertically controllable as a valve so as to control the flow of molten metal 82 out of the orifice of the orifice plate 78 as a stream 82'. As shown in FIG. 6 when the molten metal stream 82' is permitted to flow from the container it first impinges the mid point of flat surface 52 of the trough. The molten metal then travels laterally in opposite directions so as to flow simultaneously to both of the adjacent countersinks 46 and 48 and thence downwardly through the orifices 46' and 48' into the pair of full cavities. In FIG. 6 it will be seen that the molten metal is flowing down the sides of the cavities 24 and 26 to minimize any splashing of the metal and to thus prevent formation of bubbles.

After the cavities 24 and 26 are filled and the metal solidified by cooling, then the sprue cutter 40 is rotated, as aforesaid, to cut off the sprue at the juncture with the cast bullets. Then the molds are opened and the cast bullets are removed.

For some applications it may be desired only to cast a single bullet at one time and this case is depicted in FIG. 12 where the sprue plate is the same as is shown in FIG. 6, i.e., has the spaced apart countersinks but only a single bullet cavity 26' is provided in the mold. However, the stream of molten metal 82" continues to impinge on the center of the flat surface 52 of the trough adjacent to the "active" countersink to thereafter travel laterally to fill up the cavity 26'.

This invention thus is Unique as compared to prior art arrangements. It is seen that this invention, instead of pouring hot metal directly into a cavity, pours the molten metal onto a special flat receiving surface 52 on the sprue cutter which surface is closely laterally adjacent to the countersink with outlet orifice. Thus the hot molten metal flows with a minimum of turbulence laterally from the special receiving surface to the countersink and thence vertically downward through the orifices 46' and 48' and thence into the bullet molds.

Figure 9:
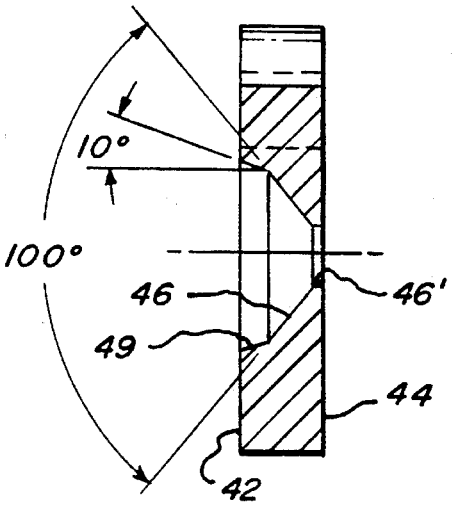
FIGS. 9, 10, and 11 are cross sections of the sprue cutter depicted in FIG. 8 as viewed along, respectively, section lines 9—9, 10—10 and 11—11.

The present invention in the preferred embodiment is further characterized as follows. First, the width of the trough 50 is the same as the diameter of the countersinks 46 and 48 as is clearly shown in FIG. 8. Second, optimum performance and results have been obtained by having the total included angle of the countersink 100 degrees as shown in FIG. 9, but this angle could vary between 80 degrees and 120 degrees. A suitable draft angle of 10 degrees is shown in FIG. 9. Also the radius R of the curved sides 52''' and 52'''' of the trough 50 (as shown in FIG. 10) is preferably 0.312 inches for a sprue cutter having a thickness of 0.250 inches, with countersink diameters 0.577 inches, orifice holes (46' and 48') 0.180 inches, and the depth of flat surface 52 from top 42 of sprue cutter 0.170 inches.

It should also be understood that the disclosed invention is not limited to the illustrated arrangement wherein the "nose" of the bullet is facing down as shown in FIGS. 2, 6 and 12; the invention may also be used in "nose up" molds, not shown, but which are well known to those skilled in the art.

The embodiments of the invention in which an exclusive property or right is claimed are defined as follows:

1. Bullet molding apparatus for casting bullets from molten metal comprising:

a) first and second mold blocks, each of said blocks having (i) inner faces with a pair of matching mold half cavities formed therein, and (ii) an upper planar surface, said blocks being adapted to be held in assembled relationship with said half cavities in abutting register, and said half cavities each opening to said upper surface so as to define, when said blocks are held in assembled relationship, the tops of a pair of full cavities, b) a sprue cutter plate having upper and lower planar surfaces pivotally mounted on said upper surface of one of said blocks so that said lower planar surface of said cutter plate abuts said upper surface of said one of said blocks, and being detachably engageable with said upper planar surface of the other of said blocks when said block inner faces are in abutting register, said sprue plate being further characterized by having (i) a pair of orifice holes in said lower planar surface spaced so as to be aligned with said tops of said cavities when said block inner faces are in abutting register, as aforesaid, and said sprue plate is in engaged condition, (ii) a pair of spaced apart countersinks recessed into said upper planar surface and in respective connecting register with said pair of orifice holes, and (iii) a flat trough in said upper planar surface connecting said pair of countersinks said flat trough having a midpoint;

c) a container of molten metal fixedly positioned adjacent and above said upper surface of said sprue cutter plate and having orifice means in the bottom thereof positioned vertically above said midpoint of said trough and means for controlling the flow of molten metal through said orifice means to provide a preselected stream of molten metal for a preselected length of time to initially impinge said midpoint of said trough and laterally to both of said countersinks and thence downwardly through said pair of sprue cutter orifice holes into said pair of full cavities.

2. Apparatus of claim 1 further characterized by said countersinks having a preselected diameter and said trough having a lateral width substantially the same as said preselected diameter.

3. Apparatus of claim 2 further characterized by said countersinks having a total included angle of approximately 100 degrees.

4. Apparatus of claim 3 further characterized by said countersinks having a draft angle of approximately 10 degrees.

5. Bullet molten metal molding apparatus comprising:

a) first and second mold blocks, each of said blocks having (i) inner faces with a half cavity formed therein, and (ii) an upper planar surface, said blocks being adapted to be held in assembled relationship with said half cavities in abutting register, and said half cavities each opening to said upper surface so as to define, when said blocks are held in assembled relationship the top of a full cavity;

b) a sprue cutter plate having upper and lower planar surfaces pivotally mounted on said upper surface of one of said blocks so that said lower planar surface of said cutter plate abuts said upper surface of said one of said blocks, and being detachably engageable with said upper planar surface to the other of said blocks when said block inner faces are in abutting register, said sprue plate being further characterized by having (i) an orifice hole in said lower planar surface spaced so as to be aligned with said top of said cavity when said block inner faces are in abutting register, as aforesaid, and said sprue plate is in engaged condition, (ii) a pair of spaced apart countersinks recessed into said upper planar surface, one of said countersinks being in connecting register with said orifice hole, and (iii) a flat trough in said upper planar surface connecting said pair of countersinks said flat trough having a midpoint; and c) a container of molten metal fixedly positioned adjacent and above said upper surface of said sprue cutter plate and having orifice means in the bottom thereof positioned vertically above said midpoint of said trough, and means for controlling the flow of molten metal through said orifice means to provide a preselected stream of molten metal for a preselected length of time to initially impinge said midpoint of said trough and thence flow laterally to both of said countersinks and thence downwardly through said sprue cutter orifice hole into said full cavity.

6. Apparatus of claim 5 further characterized by said countersinks having a preselected diameter and said trough having a lateral width substantially the same as said preselected diameter.

7. Apparatus of claim 6 further characterized by said countersink having a total included angle of approximately 100 degrees.

8. Apparatus of claim 7 further characterized by said countersink having a draft angle of approximately 10 degrees.

* * * * *